US008925284B2

(12) United States Patent
Reid

(10) Patent No.: US 8,925,284 B2
(45) Date of Patent: Jan. 6, 2015

(54) BUILDING PANEL

(75) Inventor: Andrew Wilfred Reid, West End (AU)

(73) Assignee: Halok Pty Ltd, West End, Queensland (AU)

( * ) Notice: Subject to any disclaimer, the term of this patent is extended or adjusted under 35 U.S.C. 154(b) by 11 days.

(21) Appl. No.: 13/394,178

(22) PCT Filed: Sep. 10, 2010

(86) PCT No.: PCT/AU2010/001174

§ 371 (c)(1),
(2), (4) Date: Mar. 5, 2012

(87) PCT Pub. No.: WO2011/029149

PCT Pub. Date: Mar. 17, 2011

(65) Prior Publication Data

US 2012/0159877 A1 Jun. 28, 2012

(30) Foreign Application Priority Data

Sep. 11, 2009 (AU) ..... 2009904404

(51) Int. Cl.
*E04B 1/00* (2006.01)
*E04C 2/04* (2006.01)

(52) U.S. Cl.
CPC ..... *E04C 2/049* (2013.01)
USPC ..... 52/745.19; 249/16; 264/333; 52/220.3; 52/173.1; 52/742.14

(58) Field of Classification Search
CPC ..... E04B 5/04; E04B 5/06; E04B 1/12; E04B 1/14; E04B 1/7069; E04C 3/20; E04C 2/20; E04C 2/38; E04C 2/00; E04C 2/04; C04B 24/22
USPC ..... 52/173.1, 220.1, 220.2, 220.3, 202, 52/204.1, 204.5, 745.19, 79.1, 79.14, 52/742.14; 264/219, 220, 255, 333, 225, 264/31, 35; 249/15, 16
See application file for complete search history.

(56) References Cited

U.S. PATENT DOCUMENTS

| | | | | |
|---|---|---|---|---|
| 640,176 | A * | 1/1900 | Bremer | 52/381 |
| 2,811,850 | A * | 11/1957 | Clary | 52/284 |
| 5,055,252 | A * | 10/1991 | Zimmerman | 264/263 |

(Continued)

FOREIGN PATENT DOCUMENTS

| | | |
|---|---|---|
| EP | 0056220 | 7/1982 |
| EP | 1088632 | 4/2001 |
| EP | 1568671 | 8/2005 |
| WO | WO95/11357 | 4/1995 |

OTHER PUBLICATIONS

Hardjito, D., "Studies of fly ash-based geopolymer concrete", Nov. 2005, Ph. D, Curtin University of Technology, Dept. of Civil Engineering.

*Primary Examiner* — Brian Glessner
*Assistant Examiner* — Beth Stephan
(74) *Attorney, Agent, or Firm* — DeLio, Peterson & Curcio, LLC

(57) ABSTRACT

The present invention relates to a building panel. The building panel includes a core including first geopolymer concrete. One or more protective layers are located adjacent the core. Each protective layer includes second geopolymer concrete of greater density than the first geopolymer concrete. In one embodiment, passages are defined along which air can move within the core.

21 Claims, 8 Drawing Sheets

(56) References Cited

U.S. PATENT DOCUMENTS

| | | | | | |
|---|---|---|---|---|---|
| 5,173,233 | A | * | 12/1992 | Kafarowski | 264/113 |
| 5,232,646 | A | * | 8/1993 | Nasvik et al. | 264/133 |
| 5,359,825 | A | | 11/1994 | Makarov | |
| 5,487,526 | A | * | 1/1996 | Hupp | 249/2 |
| 5,502,941 | A | * | 4/1996 | Zember et al. | 52/314 |
| 5,601,643 | A | * | 2/1997 | Silverstrim et al. | 106/624 |
| 5,614,009 | A | * | 3/1997 | Kobayashi et al. | 106/38.2 |
| 5,667,192 | A | * | 9/1997 | Van Doren | 249/82 |
| 5,669,194 | A | * | 9/1997 | Colasanto et al. | 52/236.8 |
| 5,861,105 | A | * | 1/1999 | Martineau | 249/44 |
| 5,900,180 | A | * | 5/1999 | Scott et al. | 249/61 |
| 6,385,933 | B1 | * | 5/2002 | Owens | 52/404.5 |
| 6,536,168 | B1 | * | 3/2003 | Cugini et al. | 52/220.2 |
| 6,890,124 | B2 | * | 5/2005 | Provenzano, III | 404/73 |
| 7,743,580 | B2 | * | 6/2010 | DeLoach, Sr. | 52/708 |
| 7,757,445 | B2 | * | 7/2010 | Disterhof et al. | 52/223.3 |
| 7,856,773 | B2 | * | 12/2010 | Agaiby | 52/220.2 |
| 2002/0059761 | A1 | * | 5/2002 | Budge | 52/284 |
| 2004/0000114 | A1 | * | 1/2004 | Schools et al. | 52/505 |
| 2004/0104498 | A1 | * | 6/2004 | Schneider | 264/31 |
| 2005/0188632 | A1 | * | 9/2005 | Rosen | 52/220.2 |
| 2005/0252117 | A1 | * | 11/2005 | Disterhof et al. | 52/223.6 |
| 2006/0156656 | A1 | * | 7/2006 | Robinson | 52/220.2 |
| 2007/0028552 | A1 | * | 2/2007 | DeLoach, Sr. | 52/677 |
| 2007/0144407 | A1 | | 6/2007 | Biscan et al. | |

* cited by examiner

BUILDING PANEL

This application is a National Stage entry for PCT application Serial No. PCT/AU2010/001174 filed on Sep. 10, 2010 and claims the benefit of Australian Application 2009904404 filed on Sep. 11, 2009.

TECHNICAL FIELD

The present invention generally relates to a building panel.

BACKGROUND

The reference to any prior art in this specification is not, and should not be taken as an acknowledgement or any form of suggestion that the prior art forms part of the common general knowledge.

Concrete building panels are known, and the usage of these panels in constructing buildings is on the increase. An important ingredient in conventional concrete used to make building panels is Portland cement. The production of Portland cement results in the emission of carbon dioxide to the atmosphere which can impact negatively upon the environment. Moreover, Portland cement production is not only highly energy-intensive, next to say steel and aluminium, but also consumes significant amounts of natural resources. The resulting wall panels are also comparatively heavy which can make them difficult to handle.

It is an object of the present invention to provide a building panel which is lightweight and environmentally friendly when compared with panels made from Portland cement, or at least provide a useful commercial alternative.

SUMMARY OF THE INVENTION

According to one aspect of the present invention, there is provided a building panel including:

a core including first geopolymer concrete; and one or more protective layers adjacent the core, each protective layer including second geopolymer concrete of greater density than the first geopolymer concrete.

Geopolymer concrete production is less energy-intensive and results in lesser carbon dioxide emissions than Portland cement, thereby making the building panel more environmentally friendly than existing Portland cement based panels. In addition, geopolymer concrete is inherently lighter than Portland cement which makes the resulting panels easier to handle.

Preferably, each protective layer is an outer skin layer. In one embodiment, the building panel includes two protective layers on either side of the core.

The panel may define a tongue along one edge and a groove along an opposite edge to facilitate interconnection of the panels.

The panel may include one or more tubular longitudinal formers located within the core, the longitudinal formers defining longitudinal passages along which air can move within the core. The longitudinal passages may be arranged within the core to form two staggered rows.

The panel may include a pair of tubular transverse formers defining transverse channels in air-communication with respective rows of passages. Each transverse former may define apertures in register with openings of respective longitudinal formers.

The panel may include tubular inlet formers embedded in a face of the panel, and defining inlets in air-communication with the transverse channels. Each inlet former may define an opening in register with an aperture of a transverse former.

One or more faces of the panel may include a pattern. The pattern may resemble a brick wall. The panel may define a door or window opening.

In one embodiment, the first geopolymer concrete has a density of about 600-900 kg/m$^3$ whereas the second geopolymer concrete has a density of about 1,100 kg/m$^3$.

According to another aspect of the present invention, there is provided a building including at least one water storage reservoir, the reservoir including at least one of the building panels.

The building may further include rooms located above the water storage reservoir, the rooms including at least one of the building panels.

According to another aspect of the present invention, there is provided a method for forming a building panel, the method including the steps of:

forming a core including first geopolymer concrete; and forming a protective layer adjacent the core, each protective layer including second geopolymer concrete of greater density than the first geopolymer concrete.

Prior to the step of forming the core, the method may include the steps of:

assembling a mould with a stencil at its base;

positioning tubular inlet formers within the mould; and pouring another protective layer into the mould.

The step of forming the core may involve:

pouring first geopolymer concrete into the mould;

laying a first row of tubular longitudinal formers and a first tubular transverse former upon the first geopolymer concrete, the first transverse former defining apertures in register with openings of respective longitudinal formers of the first row, each tubular inlet former defining an opening in register with an aperture of the first transverse former;

pouring first geopolymer concrete over the first row of longitudinal formers and the first transverse former;

laying a second row of tubular longitudinal formers and a second tubular transverse former upon the first geopolymer concrete, the second transverse former defining apertures in register with openings of respective longitudinal formers of the second row; and pouring first geopolymer concrete over the second row and second transverse former to complete pouring the core.

The step of forming the protective layer adjacent the core may involve pouring second geopolymer concrete over the first geopolymer concrete.

The method may further include the steps of:

curing the building panel within the mould;

tilting the cured building panel into an upright position separating the cured building panel from the mould; and removing the stencil from the building panel.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

According to an embodiment of the present invention, there is provided a building panel 2 in the form of a wall panel as shown in FIGS. 1 to 4. As can best be seen in FIG. 4, the building panel 2 includes a central core 4 of lower density lightweight geopolymer concrete (LGC), and a pair of protective skin layers 6*a*, 6*b* on either side of the core 4. Each protective skin layer 6 consists of higher density geopolymer concrete of greater density than the lower density geopolymer concrete. In particular, the lower density geopolymer concrete has a density of about 600-900 kg/m$^3$ whereas the higher density geopolymer concrete has a density of about 1,100 kg/m$^3$.

Geopolymer concrete is a class of synthetic aluminosilicate materials formed using no Portland cement and instead utilises the fly ash byproduct from coal-burning power stations. Caustic soda, sodium silicate and a foaming agent can also be used when making the geopolymer concrete which has excellent compressive strength, and other properties suited for building construction applications. The bulk cost of chemicals needed to manufacture geopolymer concrete is cheaper than those required in forming Portland cement.

Geopolymer concrete production is less energy-intensive and results in lesser carbon dioxide emissions than Portland cement, thereby making the building panel 2 more environmentally friendly than existing Portland cement based panels. In addition, geopolymer concrete is inherently lighter than Portland cement which makes the resulting panel 2 easier to handle.

The building panel 2 and method for forming the building panel 2 is described in detail below.

Figure 4:
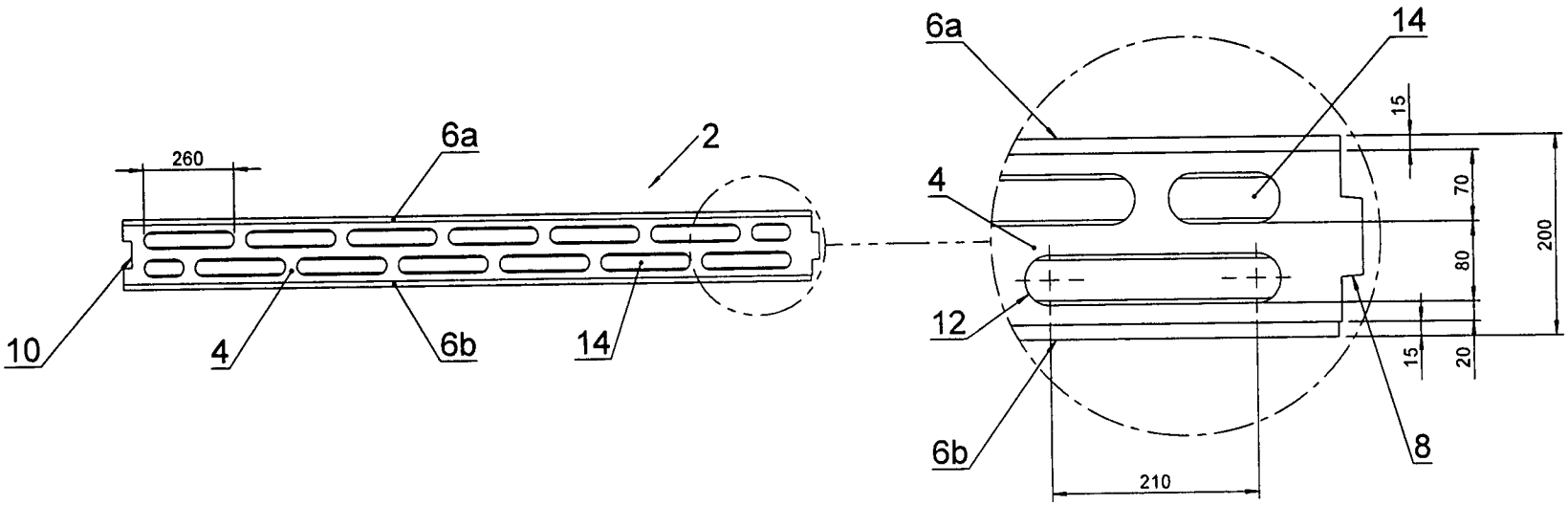
FIG. 4 is a plan view of the wall panel of FIG. 1.

As can best be seen in FIG. 4, the core 4 defines a tongue 8 along one edge and a groove 10 along an opposite edge to facilitate serial interconnection of like panels 2 together. The panel 2 also includes tubular longitudinal formers 12 located within the core 4. The longitudinal formers 12 define longitudinal passages 14 along which air can move within the core 4. The longitudinal passages 14 are arranged within the core 4 to form two staggered rows with each row forming part of a separate air circuit.

Figure 3:
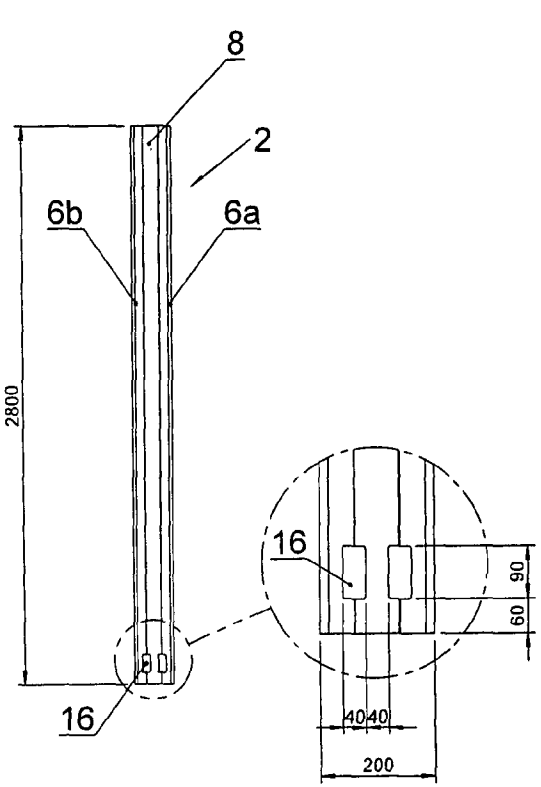
FIG. 3 is an end view of the wall panel of FIG. 1.

As can best be seen in FIG. 3, the panel 2 includes a pair of tubular transverse formers 16 defining transverse channels in air-communication with respective rows of longitudinal passages 14. Each transverse former 16 defines apertures (not shown) in register with end openings of respective longitudinal formers 12 so that air can move between the transverse formers 16 and the longitudinal formers 12.

Figure 2:
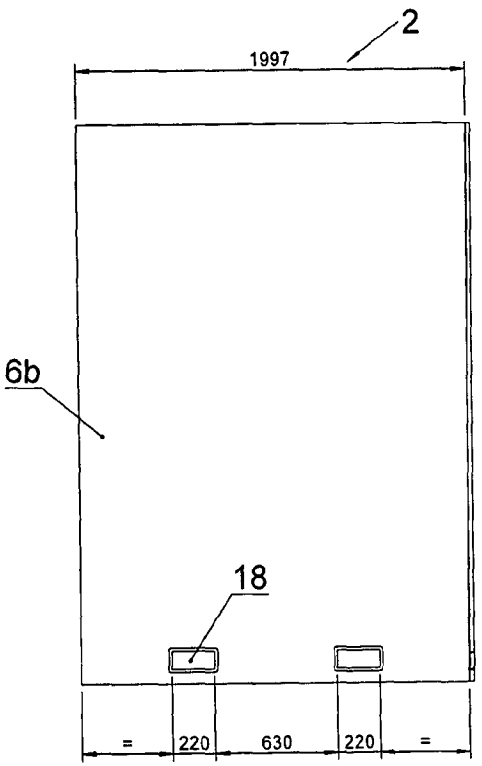
FIG. 2 is a front view of the wall panel of FIG. 1.
Figure 1:
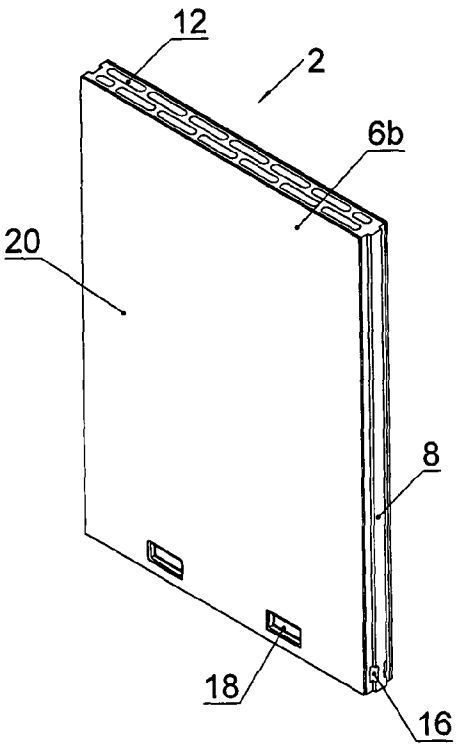
FIG. 1 is a perspective view of a wall panel in accordance with an embodiment of the present invention.

As can best be seen in FIGS. 1 and 2, the panel 2 includes a pair of tubular inlet (or vent) formers 18 embedded in a face 20 of the panel 2. Each inlet former 18 defines an inlet in air-communication with a transverse channel defined by a transverse former 16. In particular, each inlet former 18 defines an opening in register with an aperture of a transverse former 16 so that air can move between the transverse former 16 and the inlet former 18. Accordingly, air from outside the panel can move through each inlet former 18, corresponding transverse former 16 and corresponding row of longitudinal formers 12, and visa versa.

The exterior face 20 of the panel 2 defines a pattern resembling a brick wall.

Figure 5:
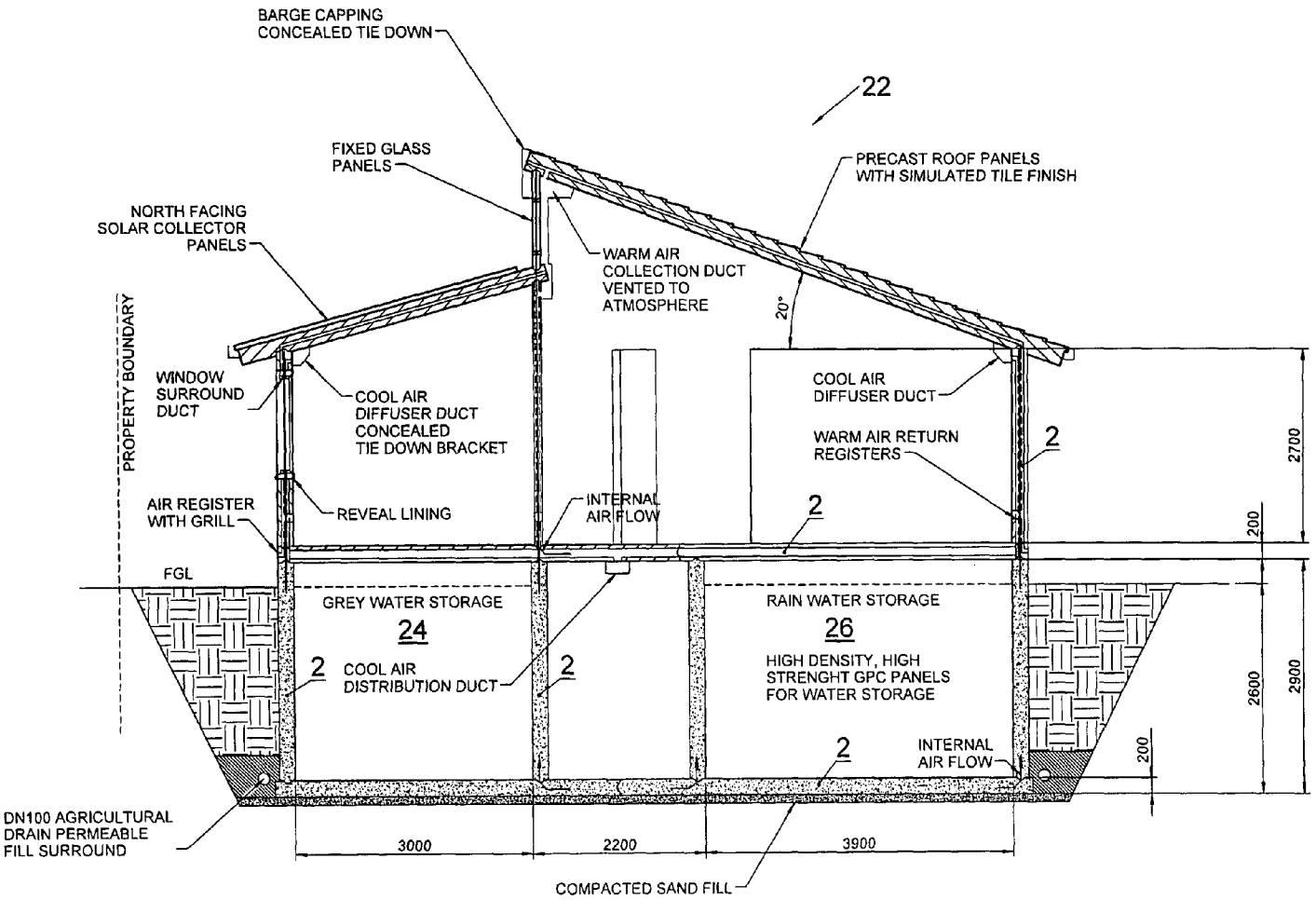
FIG. 5 is a side sectional view of a house including one or more wall panels of FIG. 1.

FIG. 5 shows a building 22 in the form of a house formed using a number of the panels 2. The building 22 includes a grey water storage reservoir 24 and a rain water storage reservoir 26 on its lowermost floor. Each reservoir 24, 26 is formed by the panels 2. The upper walls and floor of the building 22 defining rooms can also be formed by the panels 2 so that air can circulate throughout the building 22. In particular, there are provided separate cool and warm air circuits within the building 22 respectively including first and second rows of longitudinal formers 12.

A method for forming a building panel 2 is now described with reference to FIG. 6.

Figure 6A:
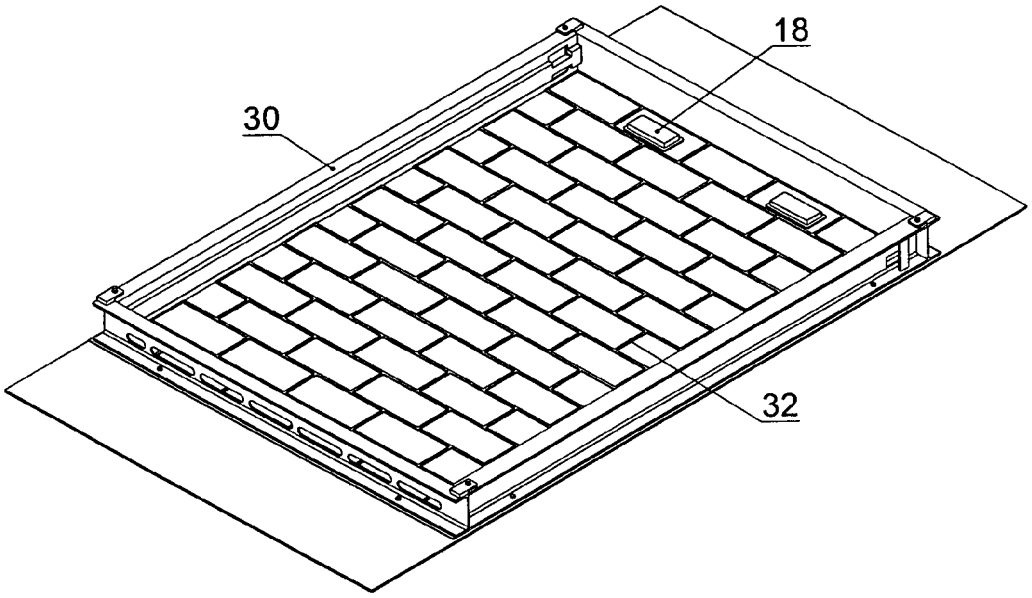
FIG. 6 shows the sequential steps involved with forming the wall panel of FIG. 1.

Turning to FIG. 6*a*, the method involves assembling a rectangular mould 30 with a stencil 32 (or stamp) resembling a brick wall at its base. The tubular inlet formers 18 are positioned within the mould 30.

Figure 6B:
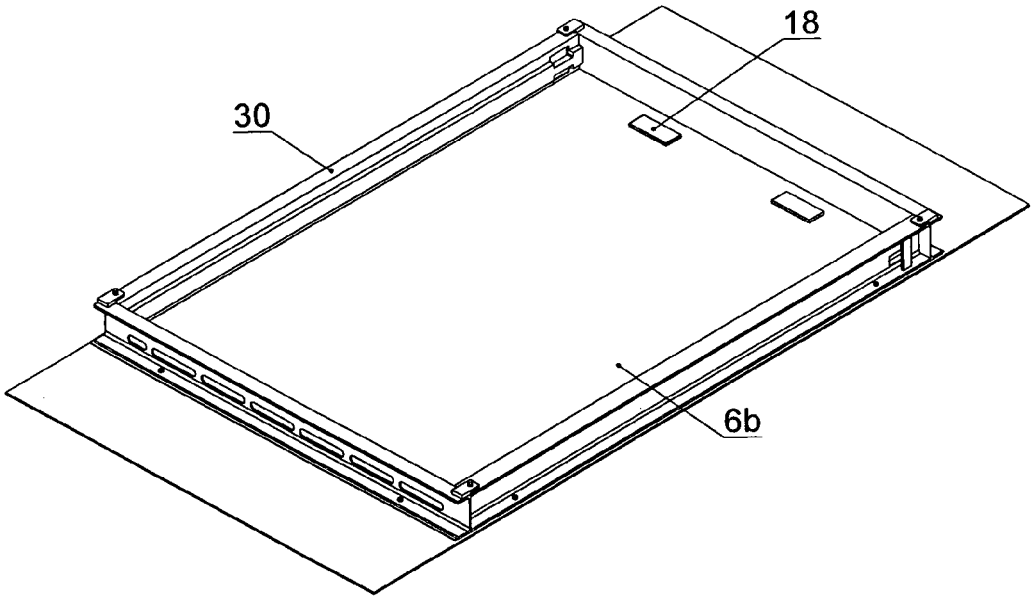

Turning to FIG. 6*b*, the exterior protective skin layer 6*b* consisting of higher density geopolymer concrete is then poured into the mould 30 to a level below the inlet formers 18. Next, the core 4 consisting of lower density geopolymer concrete is formed adjacent to and upon the skin layer 6*b* as discussed below.

Figure 6C:
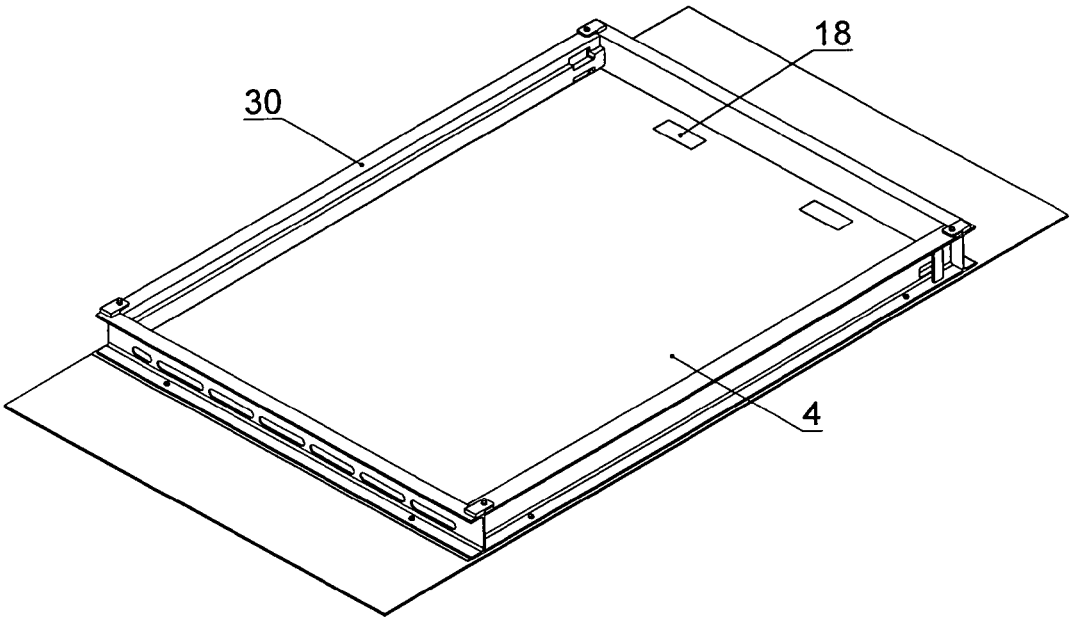

Turning to FIG. 6*c*, the step of forming the core 4 involves pouring lower density geopolymer concrete into the mould so that it is flush with the top of the inlet formers 18.

Figure 6D:
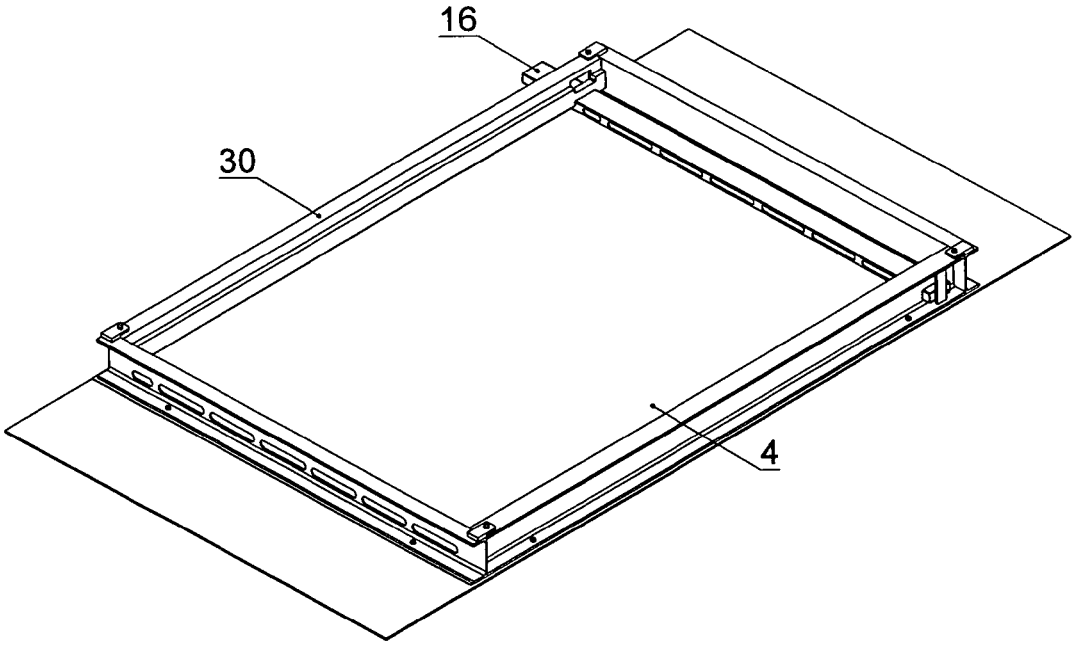
Figure 6E:
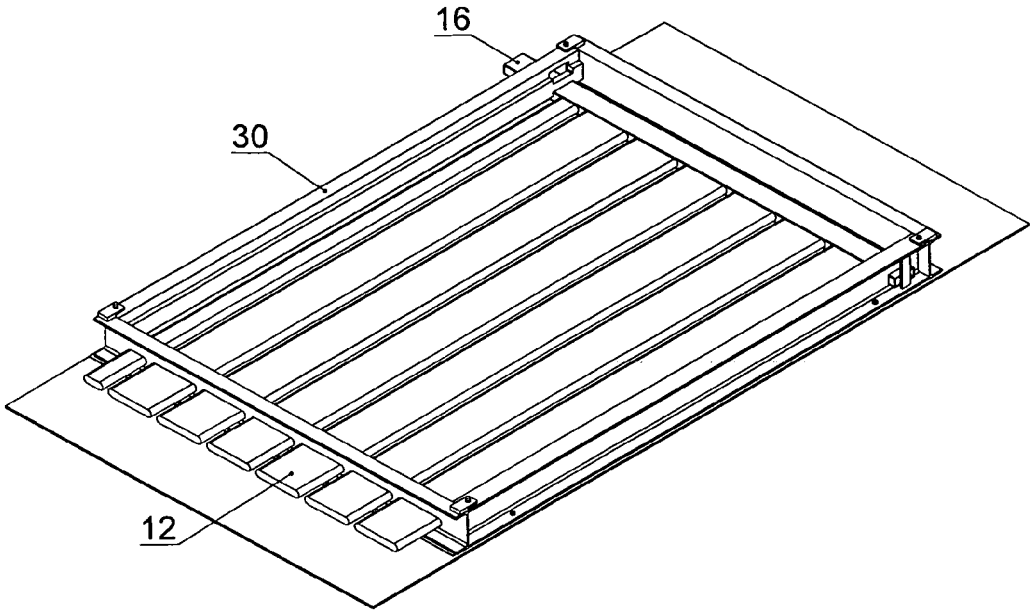

As shown in FIGS. 6*d* and 6*e*, the panel forming method involves respectively laying a first tubular transverse former 16 and a first row of longitudinal formers 12 upon the lower density geopolymer concrete. The first transverse former 16 defines apertures in register with end openings of respective longitudinal formers 12 of the first row. Each inlet former 18 defines an end opening in register with an aperture of the first transverse former 16.

Figure 6F:
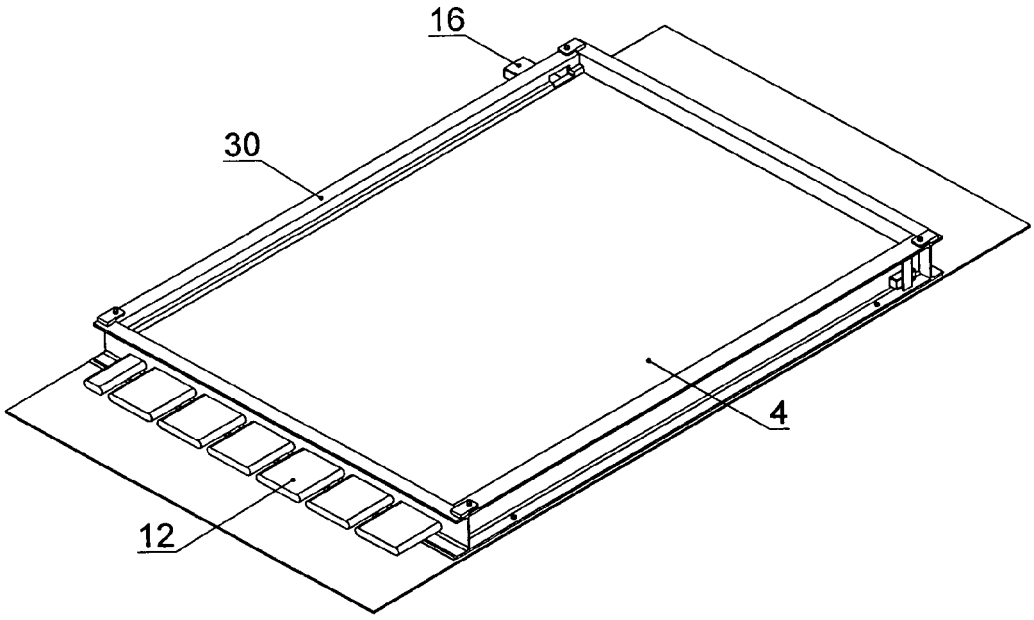

Turning to FIG. 6*f*, more lower density geopolymer concrete is then poured over the first row of longitudinal formers 12 and the first transverse former 16.

Figure 6G:
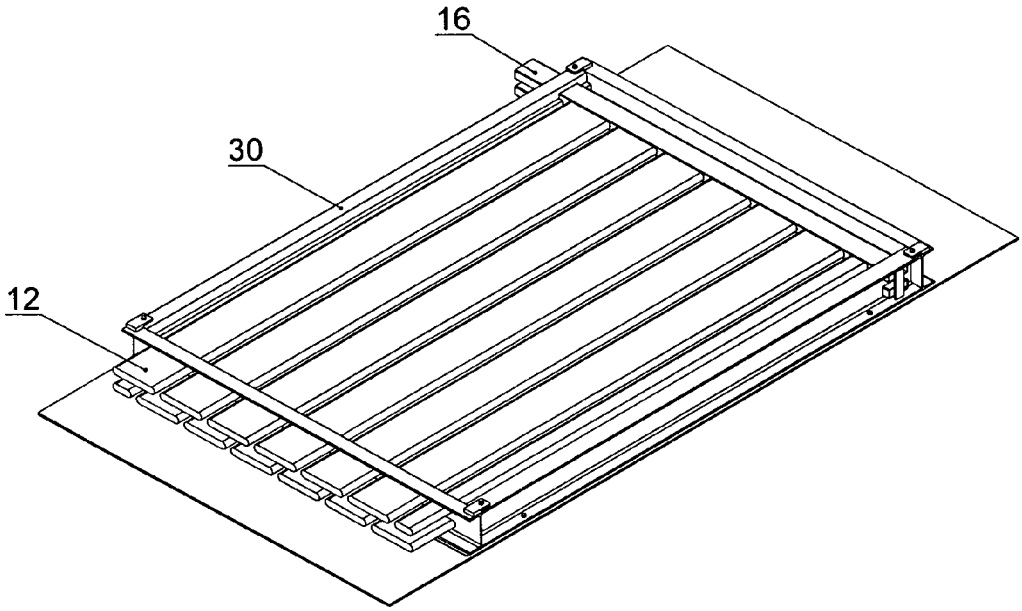

Turning to FIG. 6*g*, the panel forming method involves laying a second row of tubular longitudinal formers 12 and a second tubular transverse former 16 upon the lower density geopolymer concrete. The second transverse former 16 defines apertures in register with end openings of respective longitudinal formers 12 of the second row.

Figure 6H:
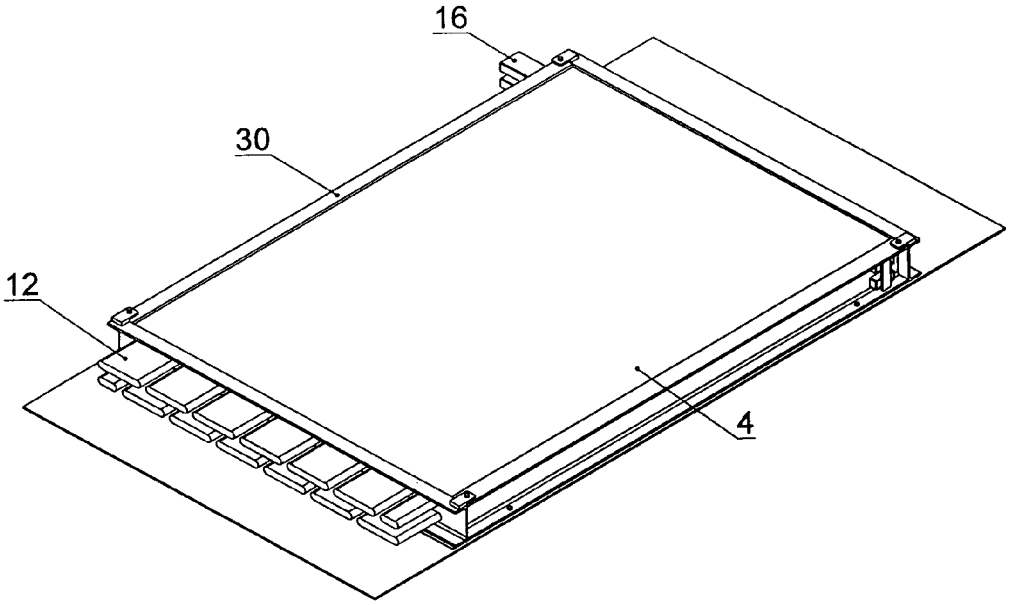

Turning to FIG. 6*h*, lower density geopolymer concrete is poured over the second row of longitudinal formers 12 and the second transverse former 16 to complete the pouring of the core 4.

Figure 6I:
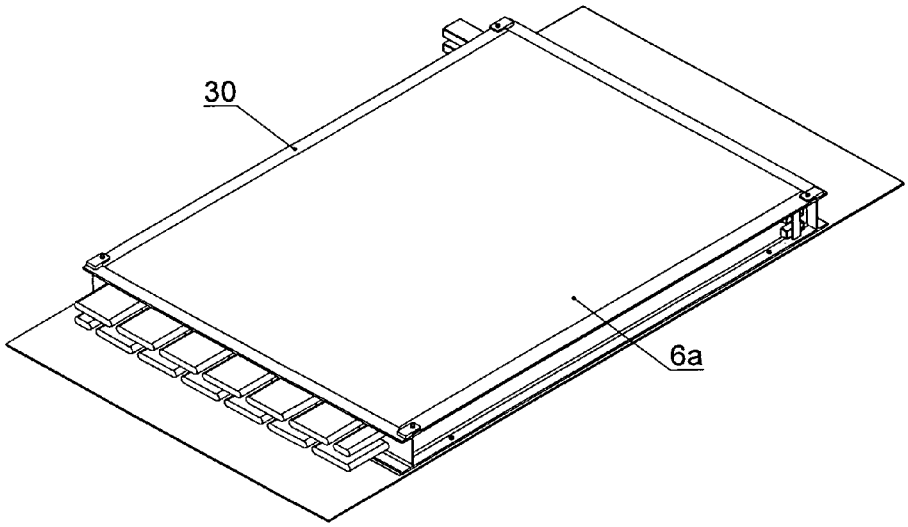

As shown in FIG. 6*i*, the interior protective skin layer 6*a* is formed adjacent the core 4 by pouring higher density geopolymer concrete over the lower density geopolymer concrete. The panel 2 is then allowed to cure before removal from the mould 30.

Figure 7:
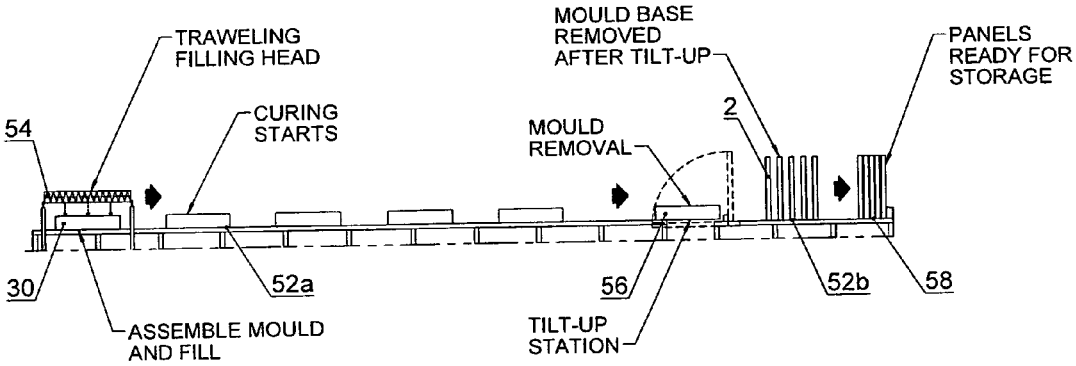
FIG. 7 is a schematic view of an assembly line for forming the wall panel of FIG. 1.

FIG. 7 shows an assembly line 50 for forming the wall panel 2. The mould 30 is initially rested at the starting end of a conveyor 52*a* and a filling head 54 pours the geopolymer concrete within the mould 30 as described above with reference to FIG. 6.

The panel forming method further involves curing the building panel 2 within the mould 30. The mould 30 is conveyed by the conveyor 52*a* to a tilt station 56. The tilting station 56 tilts the separated building panel 2 into an upright position. At the tilt station 56, the upright and cured building panel 2 is separated from the mould 30 which is removed. The stencil 32 is also removed from the building panel 2.

Another conveyor 52*b* can then convey the upright building panel 2 to a stacking station 58 where multiple building panels 2 can be stacked together.

A person skilled in the art will appreciate that many embodiments and variations can be made without departing from the ambit of the present invention.

For example, the building panel 2 may define a door or window opening.

The dimensions indicated in the Figures are in millimetres, and are by way of example only.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The claims defining the invention are as follows:

1. A building panel including:

a core including first geopolymer concrete; and one or more protective layers adjacent the core, each protective layer including second geopolymer concrete of greater density than the first geopolymer concrete;

wherein a first air passageway is defined within and extends through the panel, the first air passageway including a first transverse channel within the core and a first plurality of longitudinal passages within the core, wherein said first transverse channel is in air-communication with each of said first plurality of longitudinal passages for moving air within the core; and wherein a second air passageway is defined within and extends through the panel, the second air passageway being separate to the first air passageway and including a second transverse channel within the core and a second plurality of longitudinal passages within the core, wherein said second transverse channel is in air-communication with each of said second plurality of longitudinal passages for moving air within the core.

2. A building panel as claimed in claim 1, wherein each protective layer is an outer skin layer.

3. A building panel as claimed in claim 1, wherein the building panel includes two protective layers, one on either side of the core.

4. A building panel as claimed in claim 1, in which the panel defines a tongue along one edge and a groove along an opposite edge to facilitate interconnection of the panel to an adjacent panel.

5. A building panel as claimed in claim 1, wherein said first and second transverse channels and said first and second plurality of longitudinal passages are tubular.

6. A building panel as claimed in claim 1, wherein each of said first plurality of longitudinal passages extend between said first transverse channel and an edge of the panel, and wherein each of said second plurality of longitudinal passages extend between said second transverse channel and an edge of the panel.

7. A building panel as claimed in claim 1, wherein said first plurality of longitudinal passages form a first row and said second plurality of longitudinal passages form a second row, and said first row is not coplanar to said second row.

8. A building panel as claimed in claim 1, wherein each of said first and second transverse channels extend between opposed edges of the panel.

9. A building panel as claimed in claim 1, wherein the first air passageway includes at least one inlet defined in a face of the panel, wherein said at least one inlet is in air-communication with the first transverse channels.

10. A building panel as claimed in claim 1, wherein the first geopolymer concrete or the second geopolymer concrete is formed using a foaming agent.

11. A building panel as claimed in claim 1, wherein one or more faces of the panel include a pattern resembling a brick wall.

12. A building panel as claimed in claim 10, wherein both the first geopolymer concrete and the second geopolymer concrete is formed using a foaming agent.

13. A building panel as claimed in claim 1, wherein the panel defines a door or window opening.

14. A building panel as claimed in claim 1, wherein the first geopolymer concrete has a density of about 600-900 kg/m$^3$ whereas the second geopolymer concrete has a density of about 1,100 kg/m$^3$.

15. A building including at least one water storage reservoir, the reservoir including at least one building panel as claimed in claim 1.

16. A building as claimed in claim 15, further including rooms located above the water storage reservoir, the rooms also including at least one building panel as claimed in claim 1.

17. A method for forming a building panel, the method including the steps of:

assembling a mould;

forming a core by:

pouring first geopolymer concrete into the mould;

forming a first air passageway extending through the panel including the steps of:

laying a first row of longitudinal formers and a first transverse former upon the first geopolymer concrete, the first transverse former in register with the longitudinal formers of the first row; and pouring first geopolymer concrete over the first row of longitudinal formers and the first transverse former;

forming a second air passageway extending through the panel, including the steps of:

laying a second row of longitudinal formers and a second transverse former upon the first geopolymer concrete, the second transverse former in register with the longitudinal formers of the second row; and pouring first geopolymer concrete over the second row of longitudinal formers and said second transverse former; and forming a protective layer adjacent the core, the protective layer including second geopolymer concrete of greater density than the first geopolymer concrete.

18. A method as claimed in claim 17 wherein:

the mould has a base, the base including a stencil; and the method further includes the steps of:

positioning tubular inlet formers within the mould adjacent to the stencil;

pouring a first protective layer into the mould, the first protective layer including second geopolymer concrete of greater density than the first geopolymer concrete; and forming the core adjacent to the first protective layer, wherein in forming the core the step of laying the first transverse former upon the first geopolymer concrete includes laying the first transverse former in register with the tubular inlet formers; and wherein the step of forming a protective layer adjacent the core is a step of forming a second protective layer adjacent the core, the second protective layer including second geopolymer concrete of greater density than the first geopolymer concrete.

19. A method as claimed in claim 17, wherein:

the first row of longitudinal formers is a first row of tubular longitudinal formers;

the first transverse former is a first tubular transverse former;

the second row of longitudinal formers is a second row of tubular longitudinal formers; and the second transverse former is a second tubular transverse former.

20. A method as claimed in claim 17, wherein the step of fowling the protective layer adjacent the core involves pouring second geopolymer concrete over the first geopolymer concrete.

21. A method as claimed in claim 18, further including the steps of:

curing the building panel within the mould;

tilting the cured building panel into an upright position;

separating the cured building panel from the mould; and removing the stencil from the building panel.

* * * * *

UNITED STATES PATENT AND TRADEMARK OFFICE

CERTIFICATE OF CORRECTION

PATENT NO. : 8,925,284 B2
APPLICATION NO. : 13/394178
DATED : January 6, 2015
INVENTOR(S) : Andrew Wilfred Reid It is certified that error appears in the above-identified patent and that said Letters Patent is hereby corrected as shown below:

In the Claims

Column 7, Claim 20, line 2, delete “fowling” and substitute therefor -- forming --.

Signed and Sealed this
Twenty-eighth Day of July, 2015

Michelle K. Lee

Michelle K. Lee
*Director of the United States Patent and Trademark Office*